US011280101B2

(12) United States Patent
Checri

(10) Patent No.: US 11,280,101 B2
(45) Date of Patent: Mar. 22, 2022

(54) ROTATING TAIL BRUSH FOR POOL CLEANER

(71) Applicant: Adel Edouard Checri, Coppell, TX (US)

(72) Inventor: Adel Edouard Checri, Coppell, TX (US)

(73) Assignee: Adel Edouard Checri, Coppell, TX (US)

( * ) Notice: Subject to any disclaimer, the term of this patent is extended or adjusted under 35 U.S.C. 154(b) by 764 days.

(21) Appl. No.: 15/099,284

(22) Filed: Apr. 14, 2016

(65) Prior Publication Data

US 2017/0298645 A1 Oct. 19, 2017

(51) Int. Cl.

| | |
|---|---|
| ***E04H 4/16*** | (2006.01) |
| ***A46B 13/00*** | (2006.01) |
| ***A46B 13/02*** | (2006.01) |

(52) U.S. Cl.

CPC ..... *E04H 4/1681* (2013.01); *A46B 13/001* (2013.01); *A46B 13/02* (2013.01)

(58) Field of Classification Search

CPC ..... A46B 13/001; A46B 13/02; E04H 4/1681
See application file for complete search history.

(56) References Cited

U.S. PATENT DOCUMENTS

| | | | | |
|---|---|---|---|---|
| 3,872,533 | A * | 3/1975 | Proffit | B05B 3/0427 15/1.7 |
| 4,356,582 | A * | 11/1982 | Stephenson | E04H 4/1681 134/167 R |
| 4,651,377 | A | 3/1987 | Staples | |
| 6,119,707 | A * | 9/2000 | Jordan | E04H 4/1681 134/167 R |
| 9,119,463 | B2 | 9/2015 | Gopalan et al. | |
| 2010/0011521 | A1* | 1/2010 | Collins | E04H 4/1654 15/1.7 |
| 2012/0255579 | A1* | 10/2012 | Bloink | E04H 4/1681 134/18 |
| 2014/0124423 | A1 | 5/2014 | Gopalan et al. | |

* cited by examiner

*Primary Examiner* — Douglas Lee
(74) *Attorney, Agent, or Firm* — Baker Botts, LLP

(57) ABSTRACT

A brush for cleaning a pool includes an at least partially hollow body for receiving a hose, wherein the hose includes a plurality of rings being rotatably disposed around the hose. The brush also includes a plurality of bristles that project from the at least partially hollow body and a means for coupling the brush to at least one of the plurality of rings which facilitates rotation around the hose along with the at least one of the plurality of rings to which it is coupled.

16 Claims, 9 Drawing Sheets

ROTATING TAIL BRUSH FOR POOL CLEANER

TECHNICAL FIELD

This disclosure relates in general to cleaning a swimming pool and more particularly to a rotating tail brush for a pool cleaner.

BACKGROUND

Swimming pools are associated with a host of issues that may arise if and when a pool is not properly maintained. For example, a pool that is not routinely cleaned can endanger the health of persons who swim in the pool and can drastically reduce the lifetime of various pool equipment. Proper maintenance of a swimming pool includes cleaning the pool to ensure the pool is free from algae, bacteria and contaminants such as dirt, debris, animals, and swimmers.

SUMMARY OF THE DISCLOSURE

According to one embodiment, a brush for use in cleaning a pool includes an at least partially hollow body for receiving a hose, wherein the hose includes a plurality of rings being rotatably disposed around the hose. The brush also includes a plurality of bristles that project from the at least partially hollow body and a means for coupling the brush to at least one of the plurality of rings which facilitates rotation around the hose along with the at least one of the plurality of rings to which it is coupled.

Technical advantages of certain embodiments may include better surface scrubbing and increased lifetime due to the rotation of the brush. Additionally, certain embodiments may provide advantages such as increased reliability and reduced cost due to relatively few moving parts. Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION OF THE DISCLOSURE

Generally, cleaning a pool includes pool sweeping, surface scrubbing, and debris removal. Although these tasks are regularly performed by persons such as pool owners and/or pool cleaning service employees, manual pool cleaning is a time intensive and burdensome chore that requires a great deal of effort. As a result, many automated pool cleaners have been developed over the years such as those manufactured by Polaris, Hayward, Zodiac, and Pentair. Such automated pool cleaners usually include components to perform the various cleaning tasks. For example, an automated pool cleaner may include a tail sweep for pool sweeping, a filter bag for debris removal, and a scrubber for surface scrubbing.

Generally, a tail sweep includes a hose that is coupled to an automated pool cleaner and trails behind the pool cleaner as it drives along the surfaces of the pool. Water may be pumped through, and discharged from, the tail sweep with sufficient pressure permitting it to sweep the surfaces of the pool. Sweeping includes agitating the debris that has settled on the pool surfaces to facilitate debris removal by a filter bag of the automated pool cleaner.

Although sweeping and filtering the pool may rid a pool of some debris, it may not remove all of the debris. For example, sweeping may not remove staining resulting from chemical deposits forming over algae, dust, or dirt. Thus, it may be necessary to scrub the pool surface to remove the stain. To this end, tail sweeps typically include scrubbers.

A scrubber is typically made from a sponge-like material that rubs pool surfaces as the cleaner moves about the pool. Commonly, scrubbers are installed on the tail sweep by sliding the scrubber over the hose and into a position near the uncoupled end of the hose. To ensure the scrubber stays in position, scrubbers are configured to fit snugly around the tail sweep hose. Thus, scrubbers are substantially stationary and do not rotate around the hose. As a result, scrubbers wear unevenly without manual readjustment of the scrubber. Because of this, scrubbers are frequently replaced even though only a portion of the scrubber exhibits use or wear. Accordingly, there is a need for a rotatable scrubber that wears evenly (thereby extending the lifetime of the scrubber) and is both inexpensive to manufacture and easy to install.

These and other problems of typical scrubbers may be reduced or eliminated by using a rotating tail brush on a tail sweep. The following describes embodiments of rotating tail brushes that provide these and other desired features.

Figure 1:
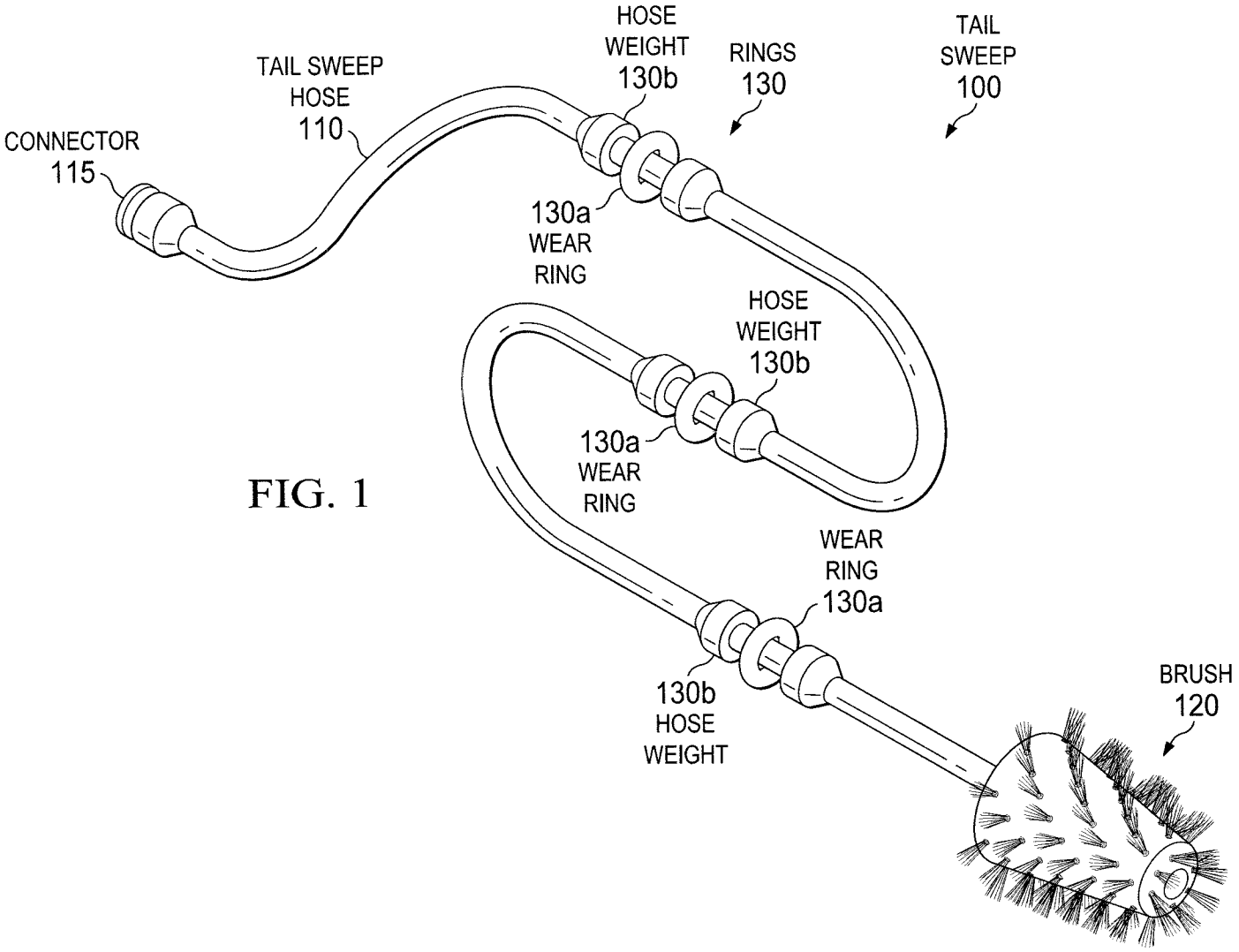
FIG. 1 illustrates an example tail sweep, according to embodiments of the present disclosure.

FIG. 1 illustrates a tail sweep 100, according to certain embodiments. Tail sweep 100 includes a tail sweep hose 110, a brush 120, and rings 130. In general, brush 120 rotates about a tail sweep hose 110 of an automated pool cleaner 500 during the cleaning of a swimming pool.

Tail sweep 100 includes multiple components with a single one of some of components being represented in FIGS. 1-5. One skilled in the art will understand that more or less than the depicted number of components can be included as performance demands dictate. One skilled in the art will also understand that tail sweep 100 can include other components that are not illustrated but are typically included with tail sweeps.

Tail sweep hose 110 may be an elongated tube permitting the pass-through of water. In some embodiments, tail sweep hose 110 is constructed from a flexible material (e.g., plastic, elastomers, etc.) to permit tail sweep hose 110 to move through the water when water is forced through tail sweep hose 110.

Figure 5:
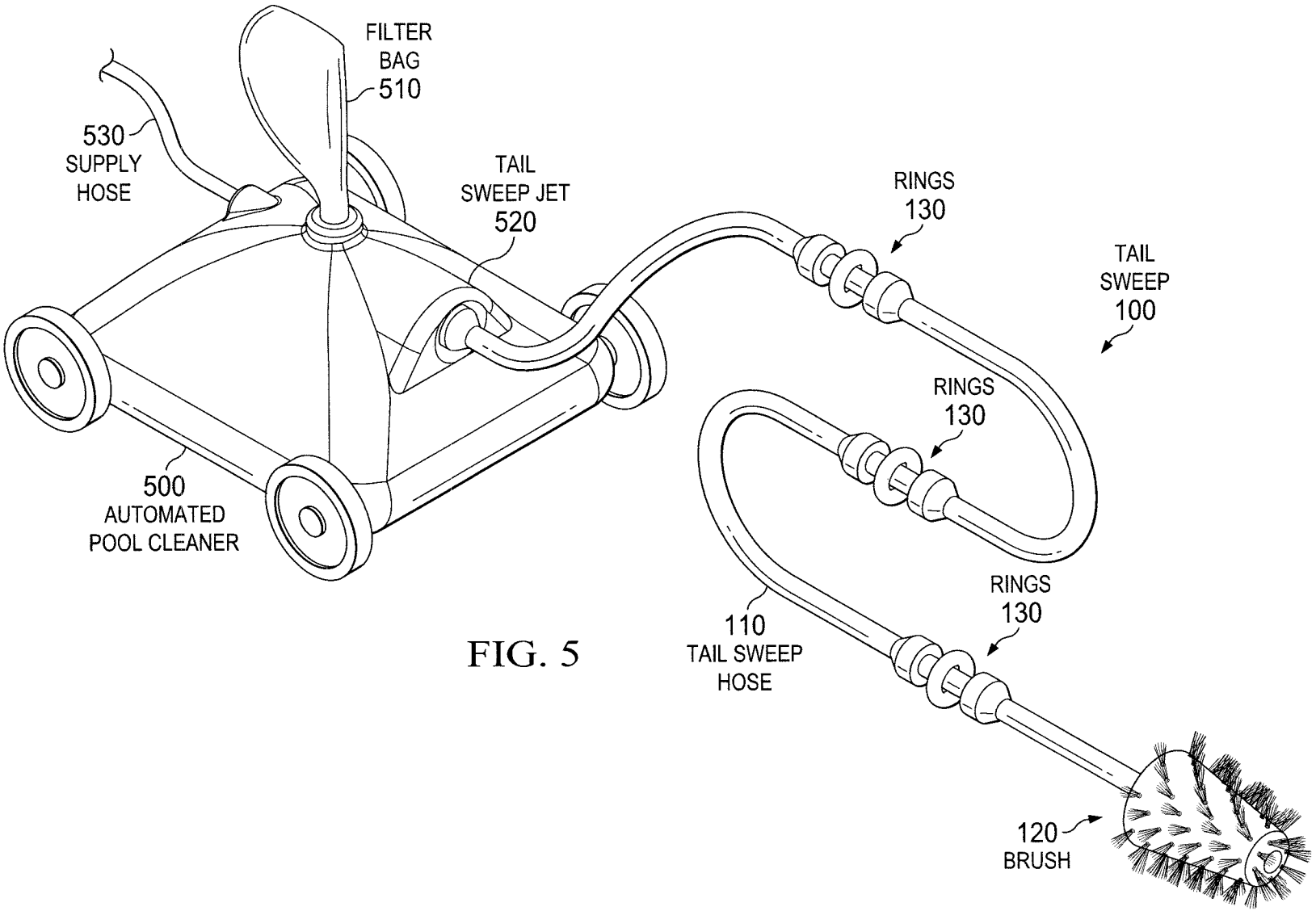
FIG. 5 illustrates an example automated pool cleaner to which the tail sweep of FIG. 1 is coupled, according to embodiments of the present disclosure.

In some embodiments, tail sweep hose 110 is configured to couple to automated pool cleaner 500 (see e.g., FIG. 5). Tail sweep hose 110 may terminate on one end with a connector 115. In some embodiments, connector 115 is used to couple tail sweep 100 to automated pool cleaner 500. As depicted, tail sweep hose 110 terminates on the end opposite connector 115 with brush 120. Brush 120 is described in more detail below in reference to FIG. 2.

In some embodiments, rings 130 are disposed around tail sweep hose 110. In some embodiments, rings 130 may be positioned along tail sweep hose 110 between connector 115 and brush 120. In some embodiments, rings 130 are freely rotatable around tail sweep hose 110. Rings 130 may be of any suitable size and any suitable shape. Any suitable number of rings 130 may be disposed around tail sweep hose 110.

In some embodiments, rings 130 are wear rings 130*a*. Generally, wear rings 130*a* protect tail sweep hose 110 from damage resulting from its movement around in the water and/or collision with pool surfaces. In some embodiments, rings 130 are hose weights 130*b*. Generally, hose weights 130*b* weigh down tail sweep 100 which encourages brush 120 to contact pool surfaces. Hose weights 130*b* may also be used to deter tail sweep 100 from whipping out of the water. Although this disclosure depicts and describes particular types of rings 130, any ring suitable to implement rotation of brush 120 may be used.

Figure 2:
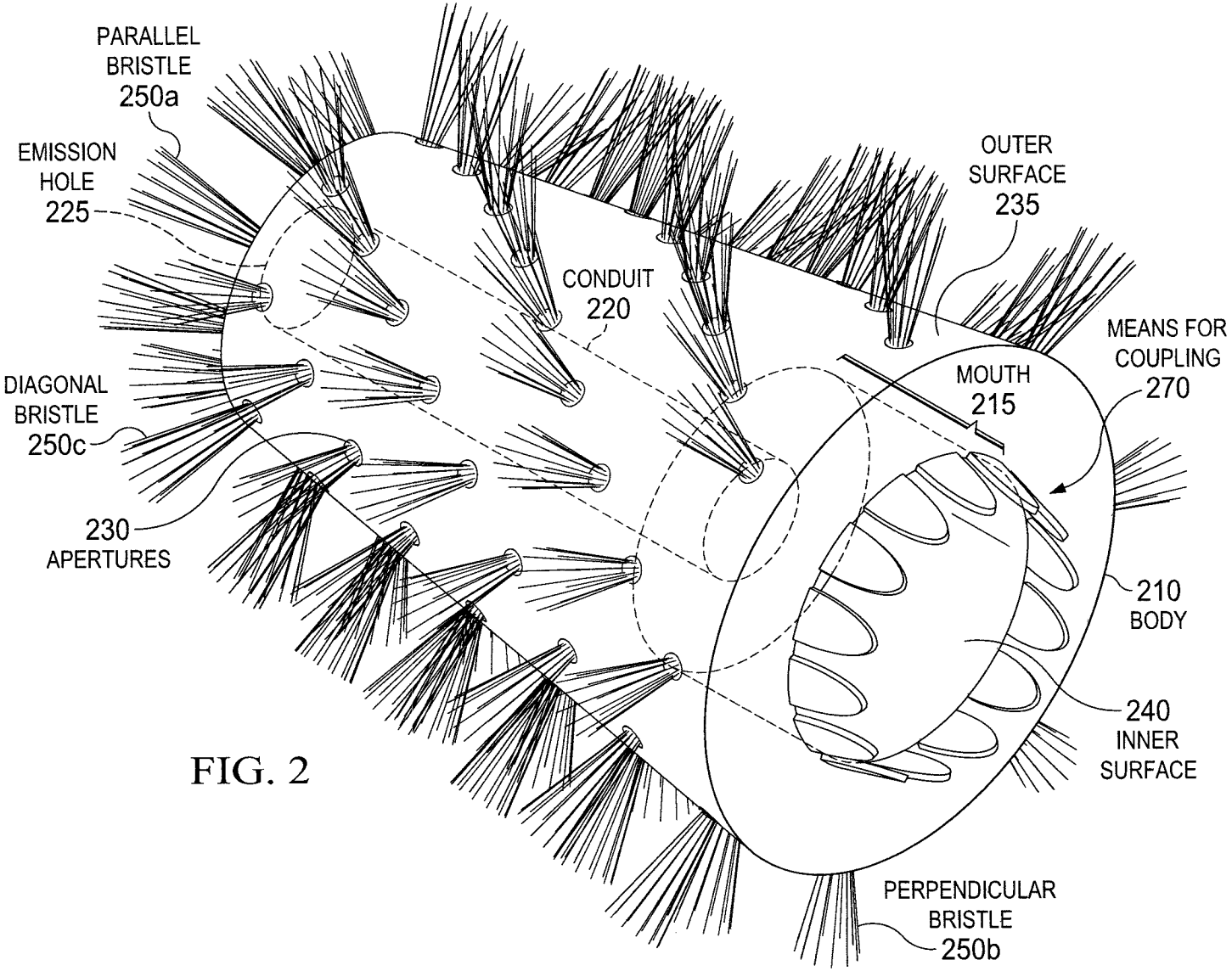
FIG. 2 illustrates a brush of the tail sweep of FIG. 1, according to embodiments of the present disclosure.

As illustrated in FIG. 2, brush 130 includes a body 210, a plurality of bristles 250, and a means for coupling 270. In some embodiments, body 210 is configured to couple to tail sweep hose 110 using means for coupling 270. Body 210 may be at least partially hollow and include a mouth 215 for receiving tail sweep hose 110. In some embodiments, body 210 includes a conduit 220 which permits water to flow through body 210 and exit through an emission hole 225.

In the illustrated embodiment, body 210 is substantially conical in shape. Although this disclosure depicts and describes body 210 having a specific configuration, body 210 may have any suitable configuration and be of any appropriate shape or dimensions. In some embodiments, body 210 is tapered. For example, body 210 may be wider at the end with mouth 215 than at the end with emission hole 225. Such tapering of brush 120 may encourage bristles 250 to make sufficient contact with pool surfaces and facilitate rotation about tail sweep hose 110.

In some embodiments, body 210 may be constructed from plastic, elastomers (e.g., Viton®, Aflas®, Kalzrez®, ethylene propylene, silicone, fluorosilicone, neoprene, nitrile, etc.) or any other suitable material. Preferably, body 210 is made from a material that is chlorine-resistant and non-corrosive.

Body 210 may also include various utility and/or design features. For example, in some embodiments, body 210 may include a plurality of apertures 230. The size and shape of apertures 230 may vary according to desired characteristics of brush 120. As one example, apertures 230 may be configured to secure bristles 250. As another example, apertures 230 may pass through to conduit 220 permitting water to spray out from apertures 230. Thus, brush 120 may clean pool surfaces with bristles 250 and/or jet action. Jet action may also be desirable to facilitate rotation about tail sweep hose 110.

In some embodiments, bristles 250 project outwardly from body 210. Brush 120 may have any suitable number of bristles 250. In some embodiments, bristles 250 may project individually from body 210 (see e.g., FIGS. 3A-3B). In other embodiments, bristles 250 may project from body 210 in clusters (see e.g., FIGS. 1-2). As used herein, a "cluster" may refer to a collection of bristles 250.

Figure 3A:
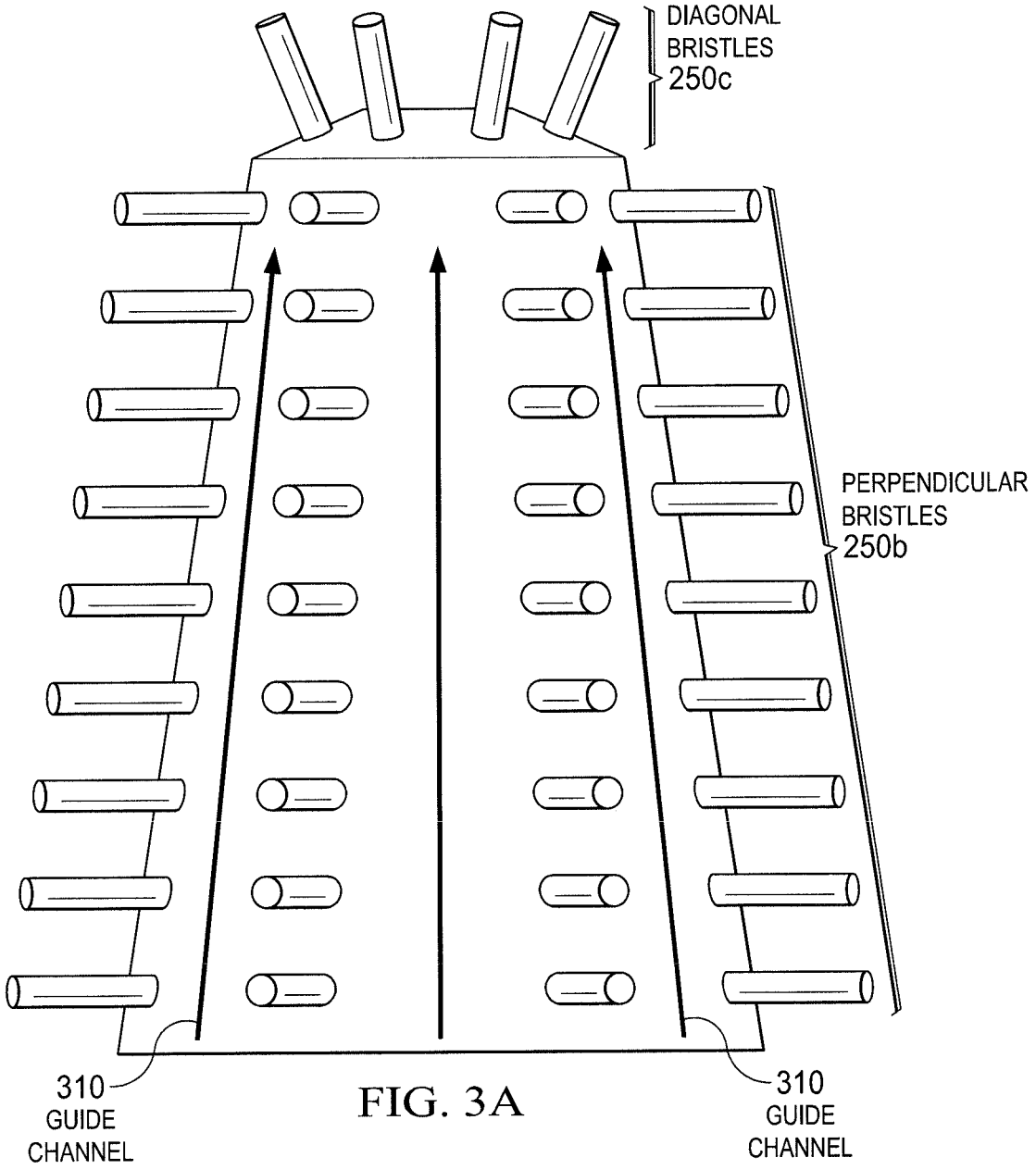
FIGS. 3A-3B illustrate example bristle configurations of the brush of FIG. 2, according to embodiments of the present disclosure.
Figure 3B:
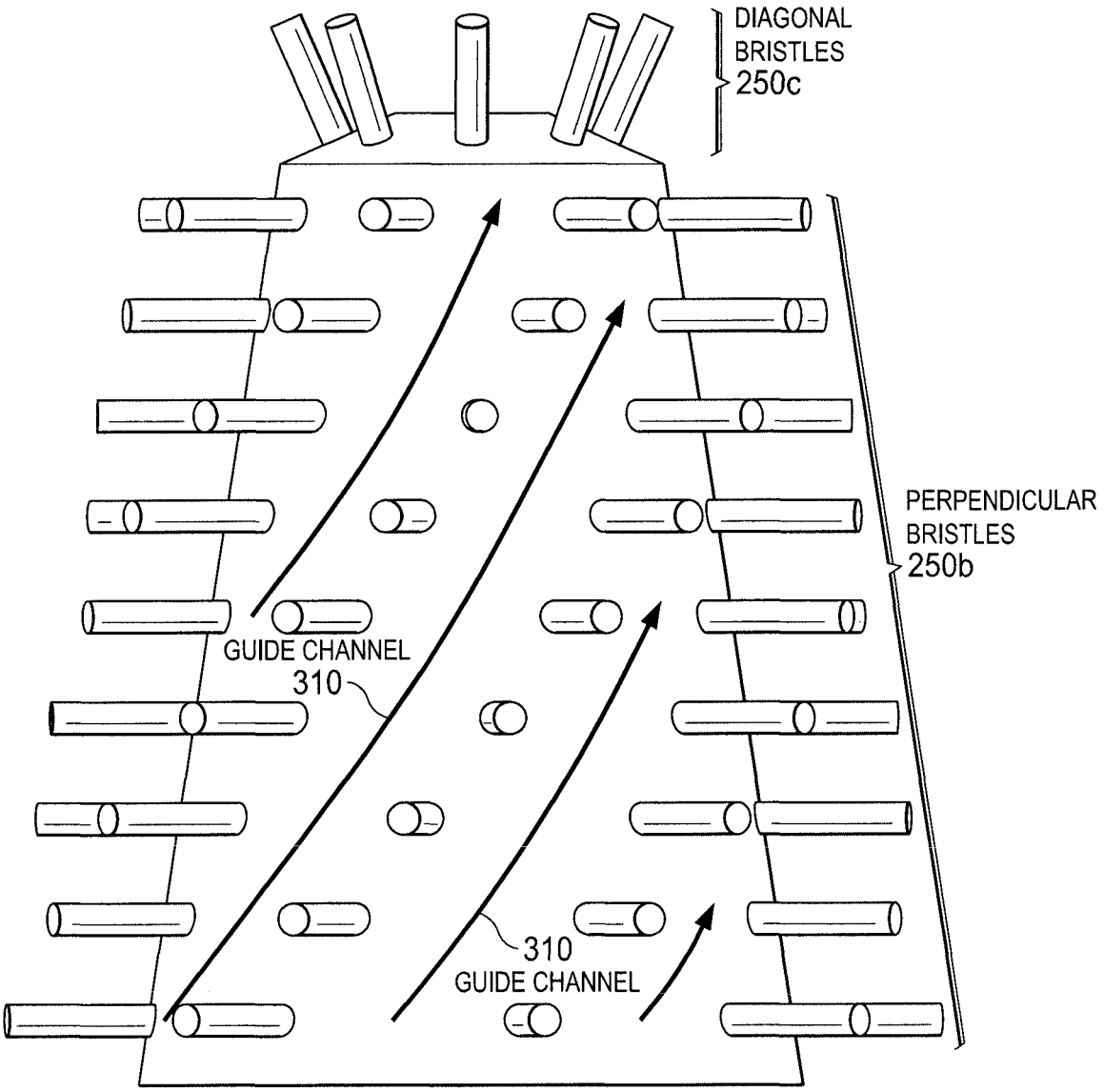

In some embodiments, bristles 250 (or clusters thereof) may be secured to a portion of body 210. For example, bristles 250 may be secured to an outer surface 235 of body 210. As another example, such as depicted in FIG. 2, bristles 250 (or clusters thereof) may be secured to an inner surface 240 of body 210 through apertures 230. In other embodiments, such as depicted in FIGS. 3A-3B, bristles 250 (or clusters thereof) may be contiguous of body 210. For example, bristles 250 and body 210 may be constructed from a single mold.

In some embodiments, bristles 250 (or clusters thereof) are configured to project from body 210 such that they are substantially parallel (e.g., within +/−20 degrees) to body 210 (e.g., bristles 250*a*). In other embodiments, bristles 250 (or clusters thereof) are configured to project from body 210 such that they are substantially perpendicular (e.g., within +/−20 degrees)) to body 210 (e.g., bristles 250*b*). In yet other embodiments, bristles 250 (or clusters thereof) are configured to project from body such that they are substantially diagonal (e.g., between 30 to 60 degrees) to body 210 (e.g., bristles 250*c*). A brush 120 comprising bristles 250 of varied projection angles may be associated with increased cleaning performance.

Bristles 250 may be made from a variety of materials. For example, they may be made from elastomers (e.g., rubber, silicone, etc.), hair (e.g., horse, ox, sheep, etc.), wood fibers (e.g., bamboo), vegetable fibers (e.g., tampico, kittool, palmyra, etc.), synthetic fibers (e.g., nylon, polyester, polypropylene, etc.), or wire (e.g., aluminum, brass, carbon steel, etc.). In some embodiments, brush 120 may include bristles made from one or more of the above-listed materials. For example, in some embodiments, a first cluster of bristles 250 may be made of elastomers and a second cluster of bristles 250 may be made of synthetic fibers. As another example, in some embodiments, a single cluster may include bristles made from animal hair, wood fibers, and wire. Although specific types of bristles have been described, bristles 250 may be made from any suitable material. Some materials may be more desirable than others based on stiffness of bristles, availability, cost, etc.

In some embodiments, brush 120 may include bristles 250 having a uniform stiffness. In other embodiments, brush 120 may include bristles 250 of varying stiffness. For example, in some embodiments, some clusters of bristles 250 may have a first stiffness and other clusters of bristles 250 may have a second stiffness. As another example, a single cluster may have bristles 250 having varied stiffness. Varying the stiffness of bristles 250 may be associated with increased cleaning performance, particularly of hard-to-remove staining.

In some embodiments, brush 120 may include bristles 250 having a uniform length. In other embodiments, brush 120 may include bristles 250 of different lengths. For example, in some embodiments, the length of bristles 250 in a first cluster is different than the length of bristles 250 in a second cluster. As another example, in some embodiments, a single cluster may include bristles 250 of different lengths. Varying the lengths of bristles may be associated with increased cleaning performance.

FIGS. 3A-3B illustrate example configurations of bristles 250. The configuration of bristles 250 (or clusters thereof) may vary. For example, in some embodiments, such as that depicted in FIG. 3A, bristles 250 are arranged in a substantially linear formation. In another embodiment, such as that depicted in FIG. 3B, bristles 250 are arranged in an elliptical formation. Although this disclosure depicts and describes specific configurations of bristles 250, brush 120 may have any suitable configuration of bristles 250.

In some embodiments, such as depicted in FIGS. 3A-3B, the configuration of bristles 250 (or clusters thereof) may form guide channels 310. Guide channels 310 may direct the flow of water through guide channels 310, thereby increasing torque on brush 120. Increasing torque on brush 120 may increase the speed of rotation of brush 120. Increasing the speed of rotation of brush 120 may be associated with certain advantages such as increased cleaning performance.

Figure 4A:
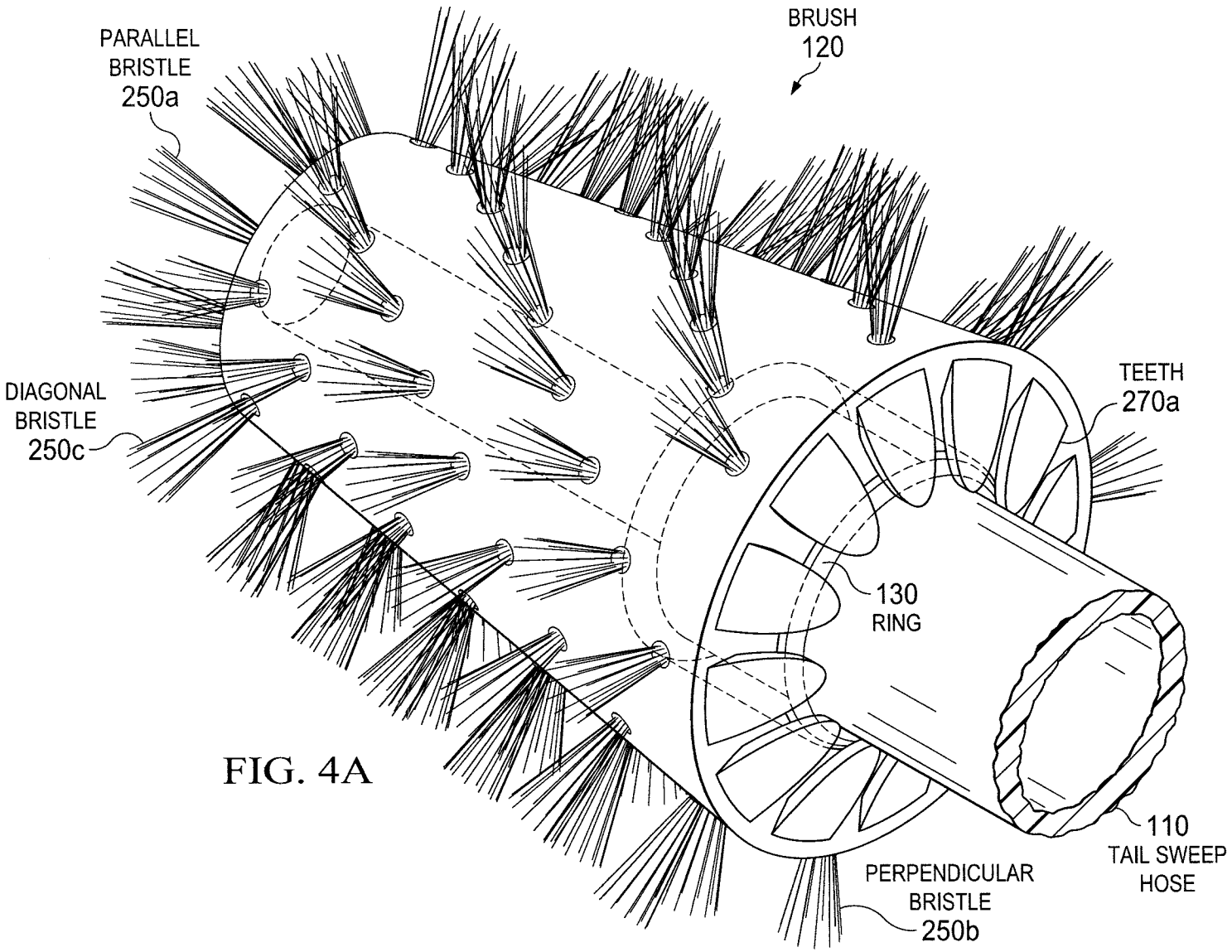
FIGS. 4A-4C illustrate example means for coupling of the brush of FIG. 2, according to embodiments of the present disclosure.
Figure 4B:
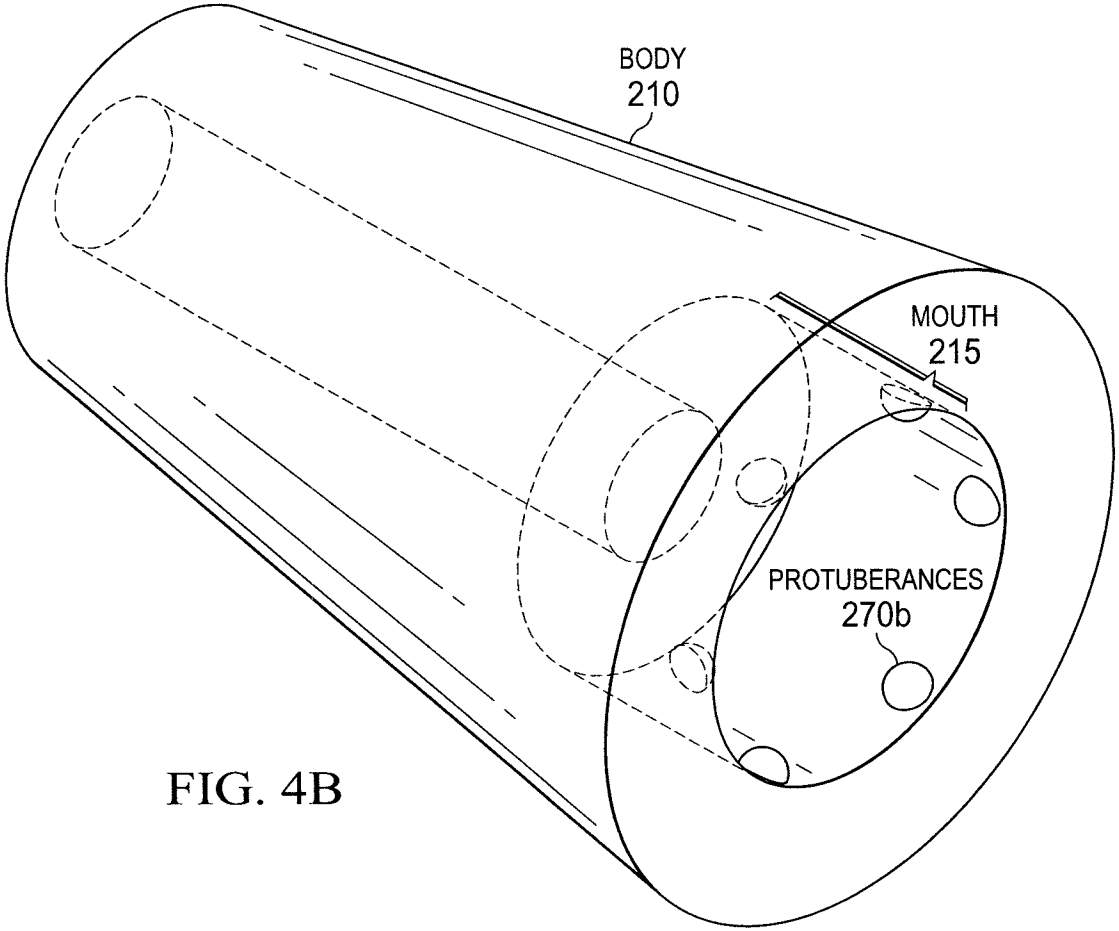
Figure 4C:
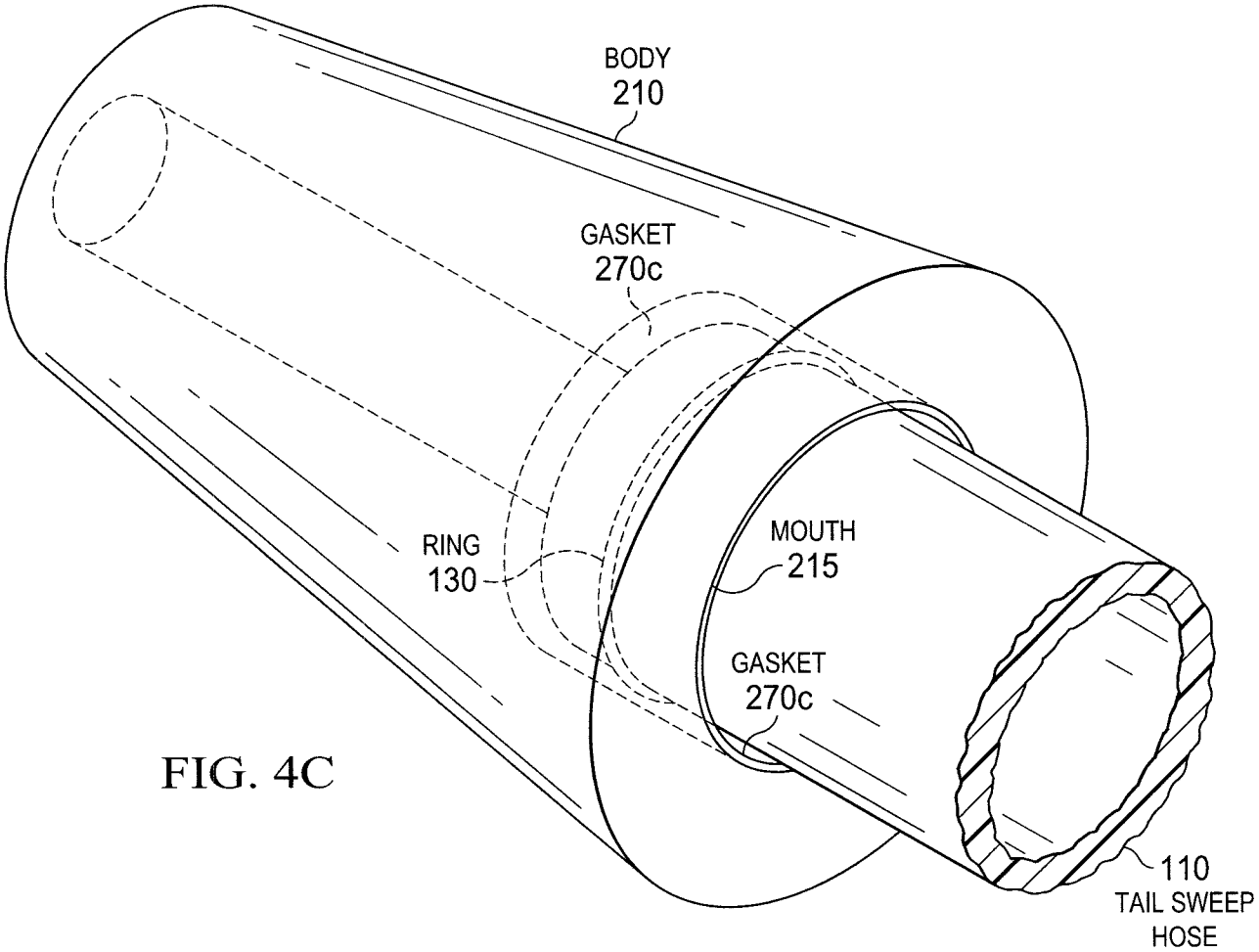

FIGS. 4A-4C illustrate examples of means for coupling 270. Generally, means for coupling 270 couples brush 120 to a ring 130 on tail sweep hose 110. In some embodiments, such as that depicted in FIGS. 4A-4C, means for coupling 270 and ring 130 are coupled by friction-fit. In other embodiments means for coupling 270 is coupled to ring 130 using one or more fasteners. Fasteners may include bolts, buttons, buckles, ties, clamps, clasps, nails, pegs, slots, and/or screws. Fasteners may also include any other suitable device that mechanically affixes means for coupling 270 to ring 130 and allows rotation of ring 130. In yet other embodiments, means for coupling 270 is coupled to ring 130 using adhesives, tape, and/or magnets.

In some embodiments, means for coupling 270 may be an extension from mouth 115. For example, in some embodiments, such as that depicted in FIG. 4A, means for coupling 270 is one or more teeth 270*a*. In some embodiments, teeth 270*a* enclose around ring 130 or tail sweep hose 110 to ensure secure coupling of brush 120 to tail sweep hose 110. Teeth 270*a* may be of any suitable size and shape. Teeth 270*a* may be made of any suitable material. In some embodiments, teeth 270*a* extend onto ring 130. In other embodiments, such as depicted in FIG. 4A, teeth 270*a* extend over ring 130 and contact tail sweep hose 110.

Teeth 270A may be tapered or untapered. Tapering teeth 270*a* may provide brush 120 with a more secure coupling because teeth 270*a* grasp tail sweep hose 110 or ring 130. As depicted in FIG. 4A, tail sweep hose 110 may be inserted into mouth 215 of brush 120 by pushing tail sweep hose 110 past teeth 270*a*. In some embodiments, teeth 270*a* may flex to accommodate tail sweep hose 110 and/or ring 130. In some embodiments, teeth 270*a* pinch down on ring 130 or tail sweep hose 110 to secure the coupling between tail sweep hose 110 and brush 120.

In some embodiments, means for coupling 270 may be positioned within mouth 215 of brush 120. For example, in some embodiments, such as depicted in FIG. 4B, means for coupling 270 may be one or more protuberances 270*b* within mouth 215. For example, mouth 215 may be lined with one or more protuberances 270*b* which provide a friction fit over ring 130. There may be any suitable number of protuberances 270*b* and that protuberances 270*b* may be of any suitable size and shape. In some embodiments, protuberances 270*b* may be configured to flex upon entry of tail sweep hose 110 into mouth 215. In other embodiments, protuberances 270*b* may be configured to be displaced or depressed upon entry of tail sweep hose 110 in mouth 215. Following clearance of ring 130, protuberances 270*b* may resume initial position, thereby securing the connection between tail sweep hose 110 and brush 120.

As another example, means for coupling 270 may be a ridge that is inset from mouth 215. In some embodiments, ridge may encircle the inner surface of mouth 115 and provide a friction fit of ring 130. In some embodiments, ridge may be configured to flex or be displaced or depressed upon entry of tail sweep hose 110 into mouth 215. Following clearance of ring 130, the ridge may resume initial position, thereby securing the connection between tail sweep hose 110 and brush 120.

In other embodiments, such as depicted in FIG. 4C, means for coupling 270 may be a seal such as a gasket 270*c*. In some embodiments, gasket 270*c* may line all or part of mouth 215 and provide a friction fit over ring 130. In other embodiments, gasket 270*c* may be placed around ring 130 and a friction fit is formed between gasket 270*c* and mouth 215 of brush 120.

In operation, brush 120 is coupled to tail sweep hose 110 using means for coupling 270 to form tail sweep 100 (see FIG. 1). Tail sweep 100 may be coupled to automated pool cleaner 500 (see FIG. 5). In some embodiments, connector 115 may be required to ensure proper coupling of tail sweep 100 and automated pool cleaner 500. In some embodiments, coupling tail sweep 100 to automated pool cleaner 500 includes coupling tail sweep 100 to tail sweep jet 520.

In some embodiments, automated pool cleaner 500 includes a supply hose 530 that is configured to couple to an inlet of a swimming pool. When coupled, automated pool cleaner 500 is provided with pressurized water which is expelled from emission hole 225 (or in some embodiments, from both emission hole 225 and apertures 230).

In some embodiments, the water flowing through automated pool cleaner 500 drives the automated pool cleaner 500 around the pool. In other embodiments, the water flowing through automated pool cleaner 500 causes tail sweep 100 to travel through the water, possibly in a whipping motion. As described earlier, the weight of rings 130 may cause tail sweep 100 to stay at or near pool surfaces permitting these surfaces to be swept and scrubbed by tail sweep 100. Sweeping may cause the dislodging of debris from a pool surface by tail sweep 100. Scrubbing may rub or buff a pool surface by tail sweep 100. Once tail sweep dislodges, displaces, or otherwise frees debris from pool surface, debris may be caught in a filter bag 510 of automated pool cleaner 500.

Movement of tail sweep 100 through the water may generate torque on rings 130, causing rings 130 to rotate around tail sweep hose 110. Because brush 120 is coupled to at least one ring 130, brush 120 rotates with that ring 130. As a result, brush 120 may rotate around tail sweep hose 110. Rotation of brush about tail sweep hose 110 may cause the bristles 250 to scrub the pool surfaces with sufficient force to remove debris and/or staining.

Figure 6:
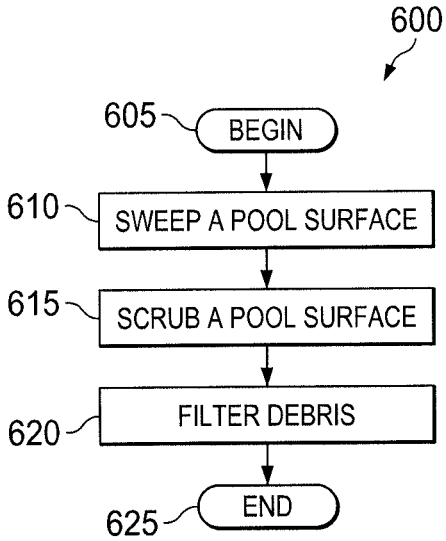
FIG. 6 illustrates an example method of cleaning a pool with the tail sweep of FIG. 1, according to embodiments of the present disclosure.

FIG. 6 illustrates a method for cleaning a swimming pool with automated pool cleaner 500, carried out according to the principles of the disclosure. The below-described steps may be performed concurrently and/or in any suitable order. The method 600 begins in a step 605.

At a step 610, tail sweep 100 sweeps at least one surface of the swimming pool. The at least one surface of the swimming pool may be any suitable surface of the swimming pool including the bottom of the pool, sides of the pool, and/or steps, stairs, or other. In some embodiments, sweeping includes contacting the at least one surface of the swimming pool with tail sweep 100 and moving tail sweep 100 relative to the at least one surface. In some embodiments, tail sweep 100 includes tail sweep hose 110 having a first and second end, wherein tail sweep hose 110 is coupled at one end to automated pool cleaner 500 and coupled to brush 120 at the other end. In some embodiments, rings 130 are rotatably disposed around tail sweep hose 110. Brush 120 includes body 210 for receiving tail sweep hose 110, bristles 250 (or clusters thereof) projecting from body 210, and means for coupling 270 brush 120 to at least one of rings 130. Bristles 250 may be arranged in any suitable configuration as described above. Sweeping by tail sweep 100 may include agitating debris from the at least one surface of the swimming pool.

In some embodiments, method 600 may continue to a step 615. In step 615, brush 120 of tail sweep 100 scrubs the at least one surface of the swimming pool. The scrubbing by brush 120 includes making contact with the at least one surface while the brush rotates around the hose 110. In some embodiments, rotation of brush 120 about the hose causes relatively even wear of bristles 250. Scrubbing with brush 120 may include rubbing or buffing the at least one surface of the swimming pool to dislodge, displace, or otherwise free debris.

In some embodiments, method 600 may continue to a step 620. In step 620, at least some of the debris is removed from the swimming pool. In some embodiments, at least some of the debris is vacuumed into filter bag 510 of automated pool cleaner 500. In other embodiments, at least some of the debris may be removed from the swimming pool by a pool skimmer. In yet other embodiments, at least some of the debris may be removed by a combination of both automated pool cleaner 500 and pool skimmer. Although various means of removal have been specifically described, this disclosure recognizes any suitable means for removing debris from swimming pool.

The method ends in a step 625. In some embodiments, method 600 may end by manual shut down of automated pool cleaner 500. In other embodiments, method 600 may end by automatic shut down of automated pool cleaner 500. For example, in some embodiments, automated pool cleaner 500 may be configured to shut off after a specified period of time. As another example, automated pool cleaner 500 may be configured to automatically shut off upon detection that filter bag 510 is completely full.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A tail sweep for cleaning a pool, comprising:
- a hose, the hose comprising a first end and a second end, wherein the first end is operable to be coupled to an automated pool cleaner;
- at least one ring disposed around the hose;
- a brush comprising:
  - an emission hole configured to expel liquid;
  - an at least partially hollow body defining a mouth and a conduit, wherein:
    - the mouth has a first diameter that is greater in size than a diameter of the at least one ring;
    - the conduit extends from an interior portion of the mouth to the emission hole; and
  - a plurality of bristles projecting from the at least partially hollow body;
  - a means for coupling the brush to the at least one ring in a manner that facilitates rotation of the brush about the hose, wherein the means for coupling is configured to:
    - deform from a static shape to a deformed shape to allow passage of the ring and the second end of the hose into the mouth; and
    - retake the static shape upon the passage of the ring and the second end of the hose, whereby retaking the static shape retains the ring and second end of the hose within the mouth.

2. The tail sweep of claim 1, wherein the plurality of bristles comprise bristles having a composition of at least one material, the at least one material being one of:
- elastomer;
- hair;
- wood fiber;
- vegetable fiber;
- synthetic fiber; or
- wire.

3. The tail sweep of claim 1, wherein the plurality of bristles comprise bristles having different stiffness.

4. The tail sweep of claim 1, wherein the plurality of bristles project from the body in an elliptical configuration.

5. The tail sweep of claim 1, wherein the at least one ring comprises a wear ring.

6. The tail sweep of claim 1, wherein the at least one ring comprises a hose weight.

7. A brush for use in cleaning a pool, comprising:
- an emission hole configured to expel liquid;
- an at least partially hollow body defining a mouth and a conduit, wherein:
  - the mouth has a first diameter that is greater in size than a diameter of a wear ring disposed about the hose;
  - the conduit extends from an interior portion of the mouth to the emission hole;
- a plurality of bristles projecting from the at least partially hollow body;
- a means for coupling the brush to the wear ring in a manner that facilitates rotation of the brush about the hose, wherein the means for coupling is configured to:
  - deform from a static position to a deformed position to allow passage of the ring and the second end of the hose into the mouth; and
  - retake the static shape upon the passage of the ring and the second end of the hose, whereby retaking the static shape retains the ring and second end of the hose within the mouth.

8. The brush of claim 7, wherein the plurality of bristles comprise bristles having a composition of at least one material, the at least one material being one of:
- elastomer;
- hair;
- wood fiber;
- vegetable fiber;
- synthetic fiber; or
- wire.

9. The brush of claim 7, wherein the plurality of bristles comprise bristles of different stiffness.

10. The brush of claim 7, wherein the plurality of bristles comprise bristles having different lengths.

11. The brush of claim 7, wherein the plurality of bristles project from the body in an elliptical configuration.

12. The brush of claim 11, wherein the elliptical configuration of bristles create a plurality of channels.

13. The brush of claim 7, wherein the plurality of bristles are configured to be substantially parallel to the at least partially hollow body.

14. The brush of claim 7, wherein the plurality of bristles are configured to be substantially perpendicular to the at least partially hollow body.

15. The brush of claim 7, wherein the at least partially hollow body is substantially conical in shape.

16. The brush of claim 7, wherein the at least partially hollow body is tapered.

* * * * *